US006782975B1

(12) United States Patent
Whittur

(10) Patent No.: US 6,782,975 B1
(45) Date of Patent: Aug. 31, 2004

(54) PRE-ASSEMBLED ELEVATOR SHAFT

(75) Inventor: Horst Whittur, Karlsfeld (DE)

(73) Assignee: Wittur AG, Wiedenzhausen (DE)

( * ) Notice: Subject to any disclaimer, the term of this patent is extended or adjusted under 35 U.S.C. 154(b) by 0 days.

(21) Appl. No.: 09/509,926

(22) PCT Filed: Oct. 1, 1998

(86) PCT No.: PCT/EP98/06255

§ 371 (c)(1),
(2), (4) Date: Jun. 23, 2000

(87) PCT Pub. No.: WO99/16694

PCT Pub. Date: Apr. 8, 1999

(30) Foreign Application Priority Data

Oct. 1, 1997 (DE) ..... 197 43 513
Nov. 25, 1997 (DE) ..... 197 52 227

(51) Int. Cl.[7] ..... B66B 17/12
(52) U.S. Cl. ..... 187/240
(58) Field of Search ..... 187/239, 240, 187/414, 254, 253

(56) References Cited

U.S. PATENT DOCUMENTS

| | | | | | |
|---|---|---|---|---|---|
| 763,989 | A | * | 7/1904 | Laughlin, Jr. | 187/257 |
| 1,164,115 | A | * | 12/1915 | Pearson | 187/254 |
| 1,208,607 | A | * | 12/1916 | Mayer et al. | 187/257 |
| 3,880,258 | A | * | 4/1975 | Rompa | 187/239 |
| 3,910,383 | A | | 10/1975 | Friedl | 187/16 |
| 4,023,655 | A | * | 5/1977 | Anzai et al. | 188/162 |
| 4,287,967 | A | * | 9/1981 | Perkins | 187/268 |
| 4,986,040 | A | * | 1/1991 | Prewer et al. | 187/414 |
| 5,052,523 | A | * | 10/1991 | Ericson | 187/350 |
| 5,145,035 | A | * | 9/1992 | Garrido et al. | 187/250 |
| 5,429,211 | A | * | 7/1995 | Aulanko et al. | 187/254 |
| 5,566,785 | A | * | 10/1996 | Hakala | 187/250 |
| 5,636,712 | A | * | 6/1997 | Muller et al. | 187/249 |
| 6,035,974 | A | * | 3/2000 | Richter et al. | 187/404 |
| 6,167,670 | B1 | * | 1/2001 | Reite et al. | 187/242 |

FOREIGN PATENT DOCUMENTS

| | | | |
|---|---|---|---|
| DE | 2 054 936 | 5/1971 | E04F/17/00 |
| DE | 26 51 566 | 5/1978 | B66B/7/02 |
| DE | 297 10 732 U1 | 8/1997 | B66B/11/04 |
| EP | 0 381 852 A1 | 8/1990 | B66B/7/02 |
| EP | 0 631 969 A2 A3 | 1/1995 | B66B/11/04 |
| EP | 0 631 970 A2 A3 | 1/1995 | B66B/11/04 |
| EP | 0 688 735 A2 A3 | 12/1995 | B66B/11/04 |
| EP | 0 745 553 A1 | 12/1996 | B66B/11/04 |
| EP | 0 767 134 A2 A3 | 4/1997 | B66B/19/00 |
| EP | 0 846 645 A1 | 6/1998 | B66B/11/00 |
| JP | 9052675 | 2/1997 | |

* cited by examiner

*Primary Examiner*—Eileen D. Lillis
*Assistant Examiner*—Charles A. Fox
(74) *Attorney, Agent, or Firm*—Fish & Richardson P.C.

(57) ABSTRACT

An elevator is provided which has a drive which in effective connection with a cable over deflection sheaves moves an elevator cabin running in a self-supporting shaft scaffold, as well as a counterweight in upward and downward directions, wherein deflection sheaves, drive sheaves as well as guide elements are combined in pre-assembled mounting units which can be quickly and easily assembled in the place of use. In addition, the elevator includes a drive which lifts and/or lowers an elevator cabin as well as a counterweight by at least one bending-flabby means guided over an arrangement of deflection sheaves, wherein the drive is incorporated into the arrangement of deflection sheaves as an element deflecting the bending-flabby means.

23 Claims, 20 Drawing Sheets

PRE-ASSEMBLED ELEVATOR SHAFT

The present invention pertains to cable elevators.

Elevator systems in which the elevator cabin is lifted or lowered by cables are sufficiently known. A common way of action therein lies in arranging the required elements, like guide rails for the elevator cabin as well as deflection sheaves for the cables etc. within an elevator shaft. This way of action is not only quite expensive as a plurality of individual elements have to be transferred to the respective mounting position, have to be arranged there individually and have to be connected with the remaining elements of the elevator, but also is essentially unsuitable for the subsequent equipment of old buildings with elevator systems, as no elevator shafts at all are existing in which the individual elements of the elevator system to be assembled could be arranged.

In order to be able to erect an elevator or to subsequently equip the housing with such one in spite of the lacking elevator shaft, the U.S. Pat. No. 3,880,258 provides that a self-supporting shaft scaffold is erected out of vertical and horizontal and vertical beams by plugging into one another individual modules consisting of vertical and horizontal beams step-by-step, i.e. one above the other, whereby a self-supporting shaft scaffold is created. On this self-supporting shaft scaffold the guide rails are fixed from the inside. These guide rails, however, only have a guide function. A load-reducing function is not taken over by the guide rails in this construction. Such erection of a self-supporting shaft scaffold thus is comparatively expensive in material and work, since after erection of the complete shaft an additional working cycle for fixation of the guide rails is required.

It, therefore, is the object of the present invention to create an elevator system which is independent from an elevator shaft provided for in a housing, which can be easily manufactured as well as being assembled economically and which in spite of the reduced material expense for the manufacture of the supporting structure also is flexible in particular in arrangeability of the drive or also the cable sheaves, for e.g. answering the most different installation demands in modernization projects.

An elevator apparatus is provided for in which the essential elements for operating the elevator, including the cable guide, deflection sheaves and drives are assembled in module-shaped mounting frames. In accordance with the present invention, these mounting units therein can be connected to form a self-supporting shaft scaffold which can be held on a house wall. The guide elements for the cabin and the guide elements for the counterweight form vertical beams of the shaft scaffold. By connecting them with the mounting frames forming the horizontal beams of the shaft scaffold, a self-supporting shaft scaffold is created with low material expense.

Simultaneously there are good possibilities for adaptation to the respective individual installment situation. Thus, e.g. in adaptation to the respective individual case it can be chosen which mounting frame is to be the one which accommodates the drive. In addition, there are manifold possibilities to individually define in which way and manner the respective elevator components, the drive and the cable sheaves are to be mounted on the mounting frame. Thus, there is the possibility of mounting within as well as outside of the shaft cross-section bordered by the module-shaped mounting elements. Simultaneously, such a self-supporting shaft scaffold for an elevator can serve as support element for a protective lining in that lining plates are mounted thereon.

The module-shaped mounting elements therein preferably are delivered as pre-assembled units to the place of installation and are assembled only.

Further features and advantages of the present invention result from the following description of the attached drawing, wherein:

FIGS. 1 to 4, and FIGS. 14 to 17 are further embodiments of elevators with drive units located in the elevator shaft, of another kind than that shown in FIGS. 1 to 13.

Figure 1:
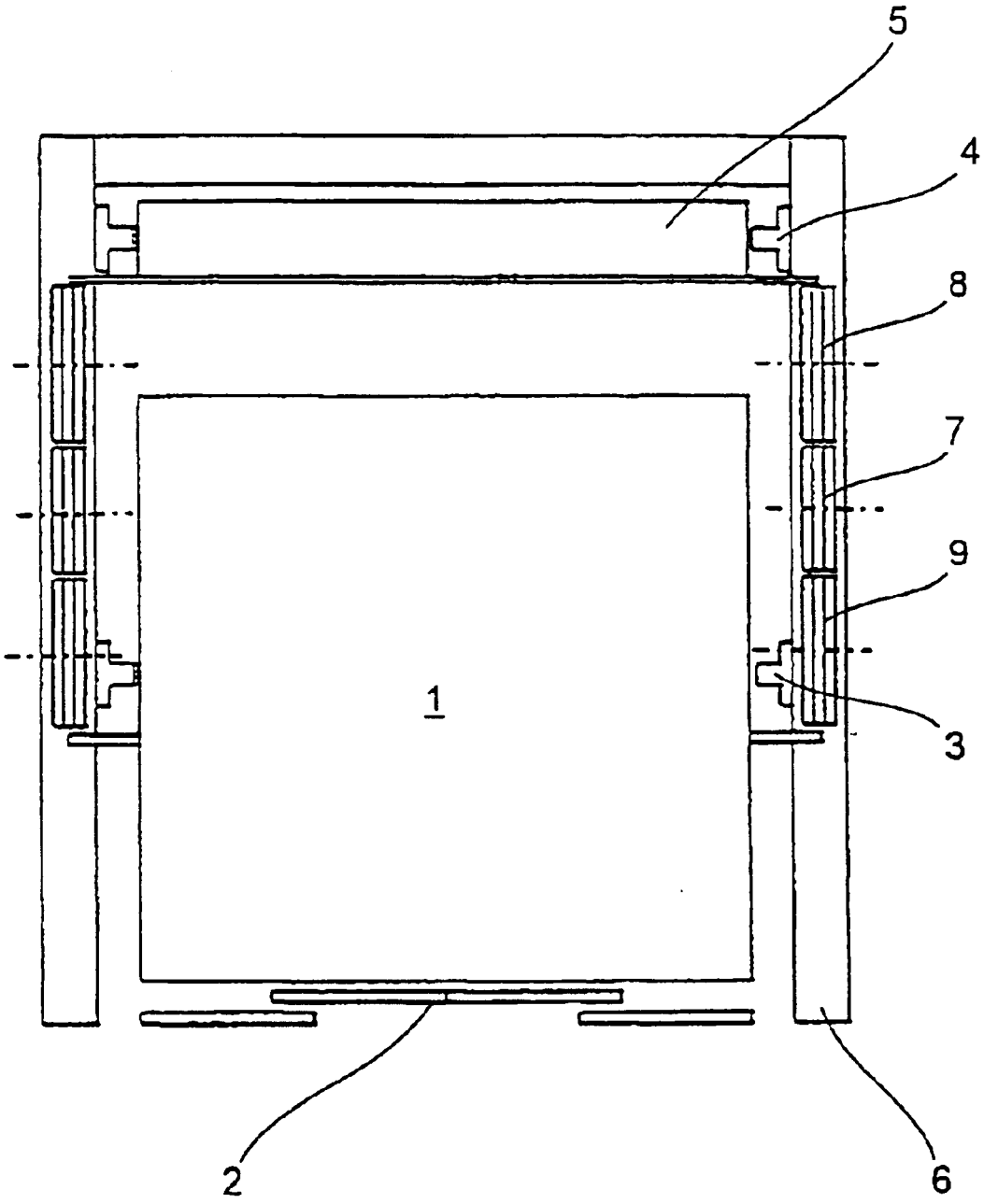
FIG. 1 is a top view onto an embodiment of the present invention with two disc engines located on bottom.

FIG. 1 shows a top view onto an embodiment of the present invention, in which an elevator cabin 1 provided with sliding doors 2, arranged and guided within a self-supporting shaft scaffold consisting of vertically extending segmented guide elements 3 for said cabin 1, also vertically extending segmented guide elements 4 for a counterweight 5 and as well as of module-shaped mounting frames 6 preferably manufactured of sheets bent in U-shape and open to bottom, by which said guide elements 3 and 4 can be connected, preferably screwed or welded together. Said mounting frames 6 therein can be located in arbitrary vertical position on said guide elements 3 and 4, on the intersecting points of the individual segments of said vertical guide elements in particular for connection thereof. At or in said module elements 6, driving disks 7 as well as cable sheaves 8 and 9 can be pre-assembled, which serve for driving and guiding the cable or flat band (not shown) required for lifting and lowering said elevator cabin 1. In the embodiment shown in FIG. 1 the two opposing driving disks 7 are made rotate using a full floating axle (not shown) or hollow shaft, which can be embodied with gear, without gear, as ring engine, special engine, flat engine or any other possible drive unit, wherein said drive a/o. can be disposed e.g. vertically on or in said shaft wall or house wall in front of which said shaft scaffold is mounted.

Figure 2:
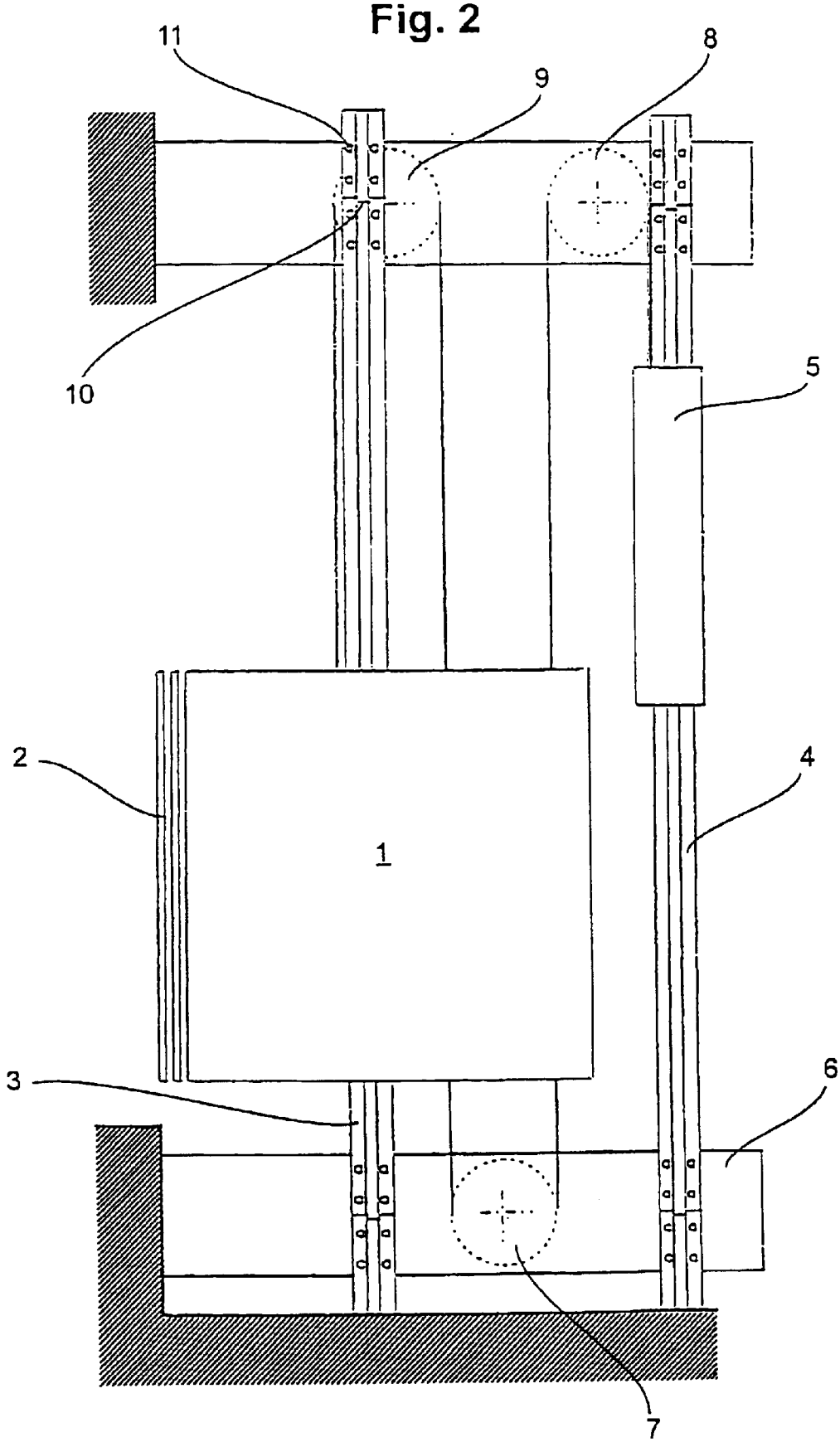
FIG. 2 is a side view of the embodiment shown in FIG. 1.

FIG. 2 shows a partial side view of the embodiment to be taken from FIG. 1 of the present invention. Corresponding elements therein are provided with corresponding reference numbers. From FIG. 2 the connection in particular of the individual segments of the said vertical guide elements 3 and 4 by said module elements 6 can be taken, said segments of said guide elements 3 and 4 engaging at the working face like groove and tongue and being fixed to said mounting frame 6 using fixation means like screws 11 or the like.

Therein FIG. 2 shows a so-called 1:1 embodiment. I.e. the loads (the cabin and the counterweight) to be lifted or lowered, respectively, each are fixed to one end of said flat belt or cable. Neither cabin nor the counterweight are suspended in block and pulley (no block and pulley effect is realized). A drive not shown which acts on said driving disks in accordance with the embodiment under FIG. 1 is disposed in the area of said lower mounting frame 6 together with said driving disks 7. I.e. here the embodiment "drive on bottom" is realized.

A drive (not shown) which in accordance with the embodiment under FIG. 1 acts onto said driving disks 7 can in modification of the embodiment shown in FIGS. 1 and 2 be arranged in the most different positions of the shaft scaffold formed by said guide elements 3 and 4 and said mounting frame 6, i.e. on the lower mounting frame 6 and on the upper mounting frame 6 as well as also on a further mounting frame possibly to be provided for as well as within or outside of the elevator shaft formed by said shaft scaffold.

Figure 2A:
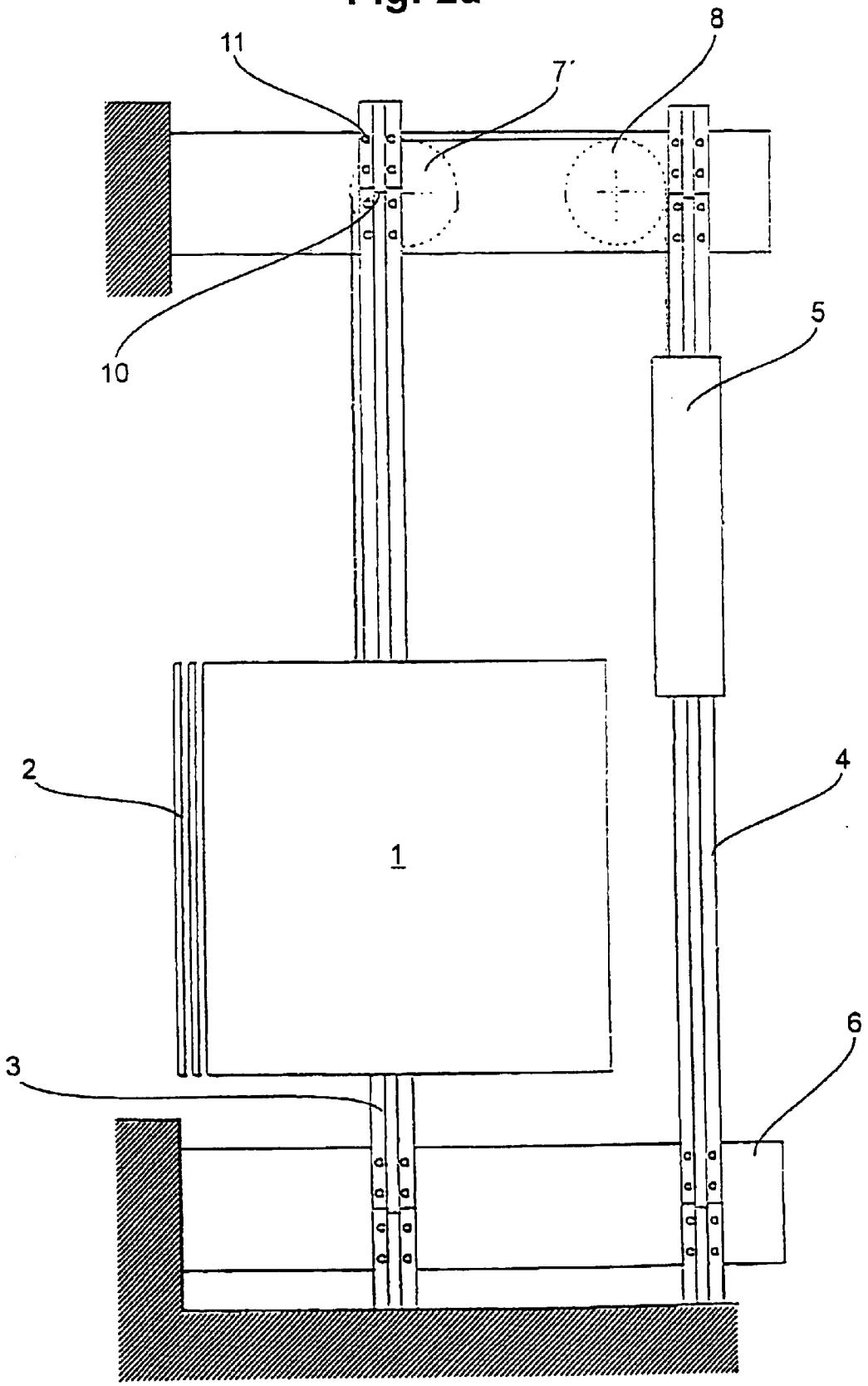

FIG. 2*a* shows a partial side view of an embodiment which came into existence from a modification of FIG. 1. In this embodiment the 1:1 principle is realized. However, the drive 7' not shown, now is arranged on said upper mounting frame together with said driving disks, the principle "drive on top" is realized.

Figure 2B:
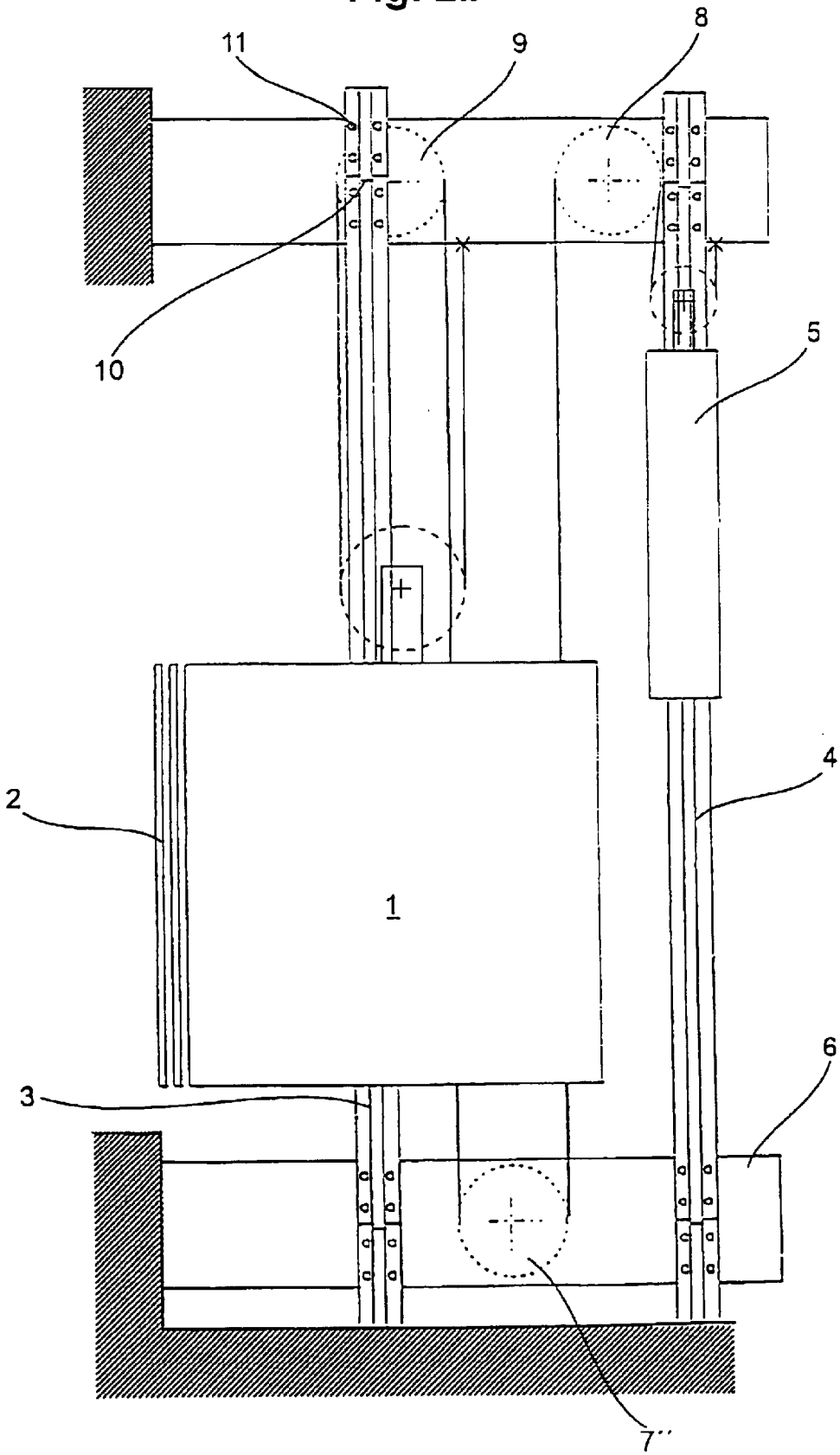

A further modification is shown in FIG. 2*b*. Here, the drive not shown as well as driving disks 7" again are disposed on said lower mounting frame (principle "drive on bottom"), but here the so-called 2:1 principle is realized. Both ends of the elevator cable or flat belt are fixed to the building. Said elevator cabin as well as said counterweight are suspended in block and pulley, i.e. the so-called block and pulley effect is made use of.

Figure 2C:
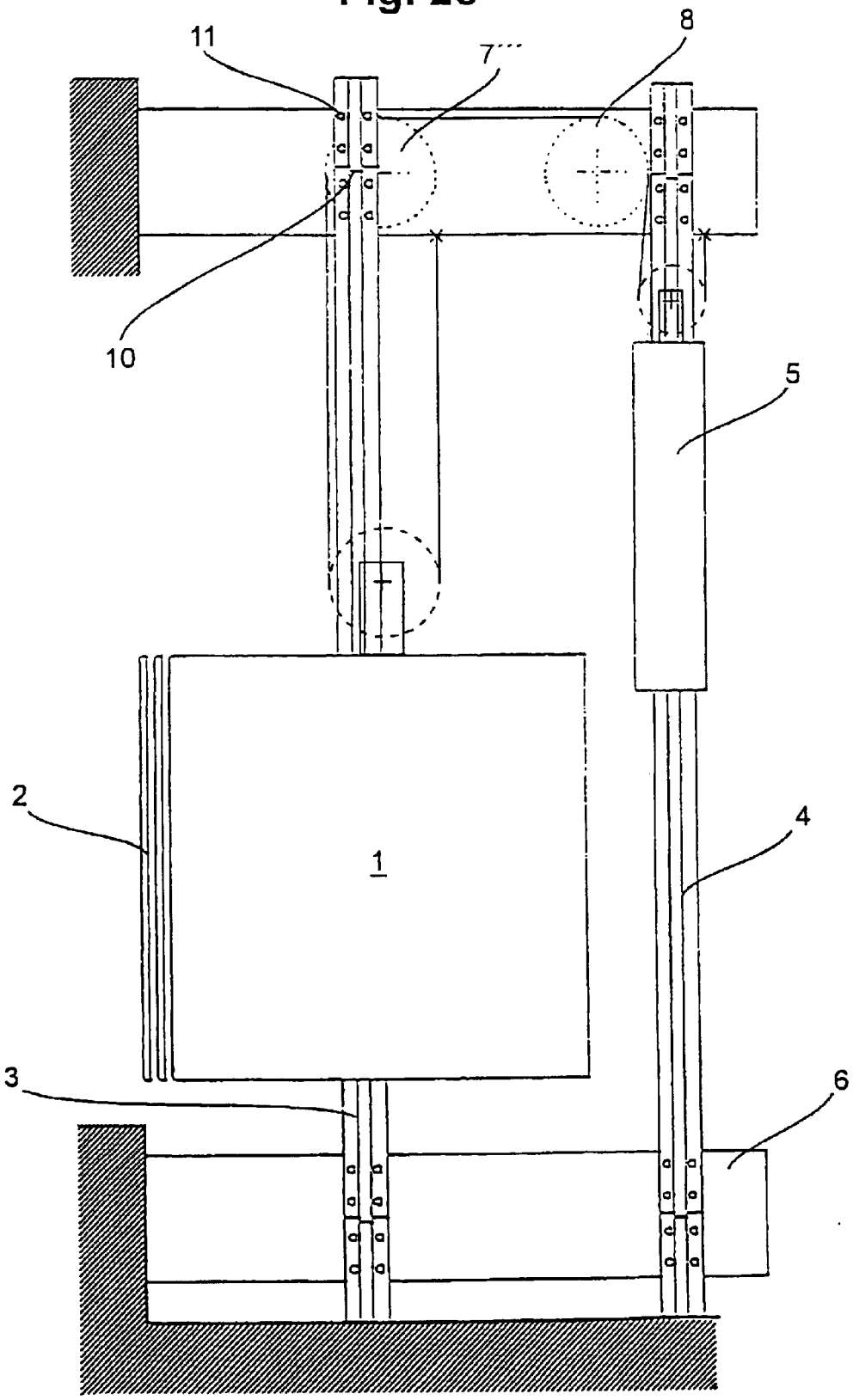

FIG. 2*c* shows a further modification. This embodiment as well works under the so-called 2:1 principle. In this embodiment, however, the drive not shown together with the relating driving disks 7" again is located in said upper mounting frame 6, i.e. the principle "drive on top" is realized.

Figure 3:
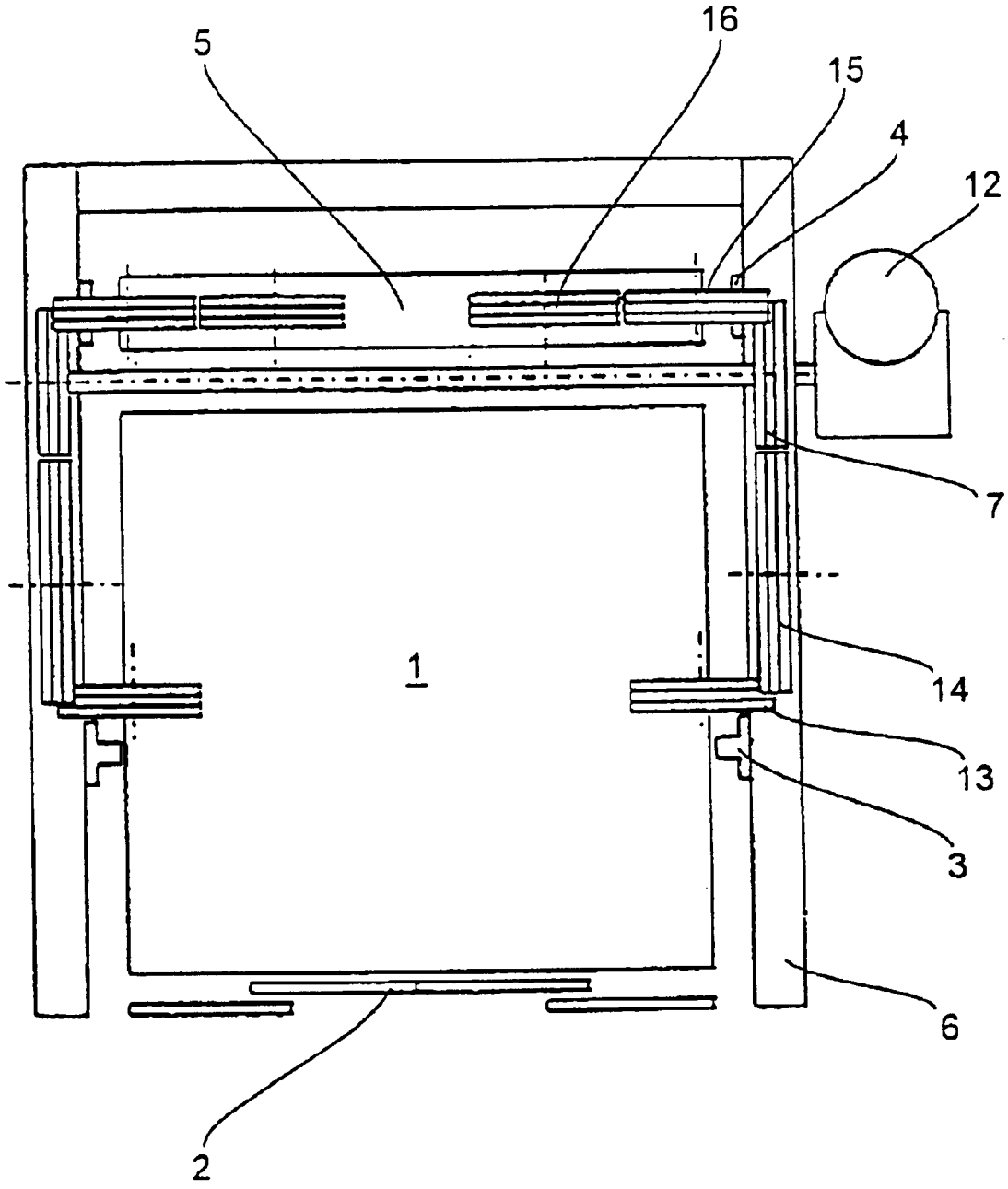
FIG. 3 is a top view onto another embodiment of the present invention with gear.

In the embodiment shown in FIG. 3 the engine is located outside of the elevator shaft formed by said shaft scaffold of the kind as described with respect to FIGS. 1 and 2, wherein, however, also arrangements of the drive 12 in the middle between said two driven driving disks 7 or in any other arbitrary position between said driving disks 7 are possible. The embodiment of FIG. 3 differs from the embodiment also with respect to the number as well as the arrangement of said cable sheaves 13 to 16 via which again the cable or flat belt required for lifting and lowering said cabin 1 as well as said counterweight 5 is guided.

Figure 4:
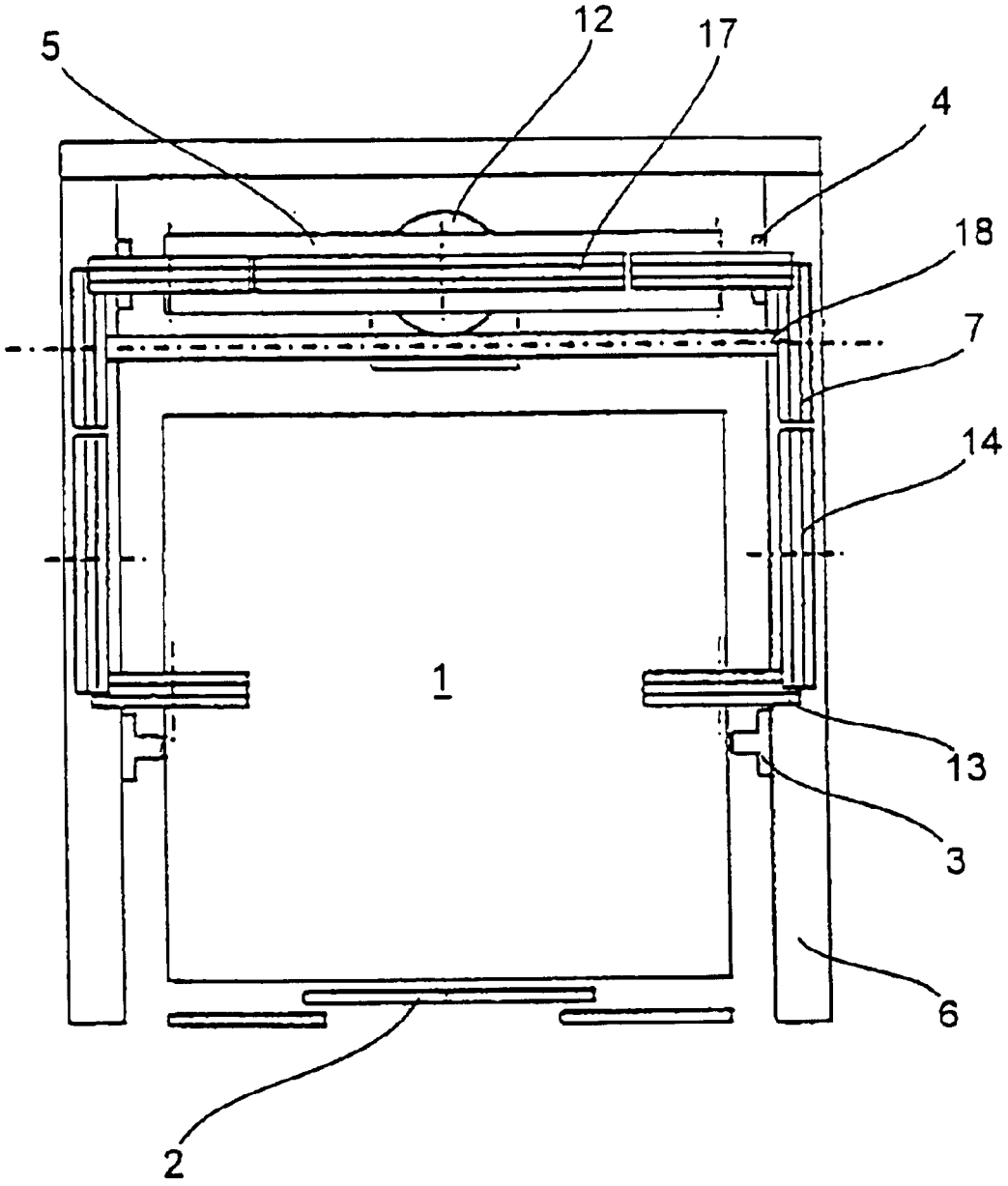
FIG. 4 is a top view onto another embodiment of the present invention with gear.

FIG. 4 shows a further embodiment of the present invention. In difference to the embodiments under FIG. 3 said cable sheaves 16 are substituted for by a cable sheave 17 fixed to said counterweight 5. The drive again is effected using driving disks 7 which are driven by a shaft 18 connecting them, said drive being arranged in the middle between said driving disks 7 on said shaft 18. In the embodiment shown in FIG. 3 the drive 12 therein is seated in the area of a lower mounting frame 6. It also is conceivable to arrange said drive 12 in the area of said upper mounting unit 6 which together with said guide elements 3 and 4 as well as said upper mounting units 6 form said shaft scaffold for the elevator.

Figure 5:
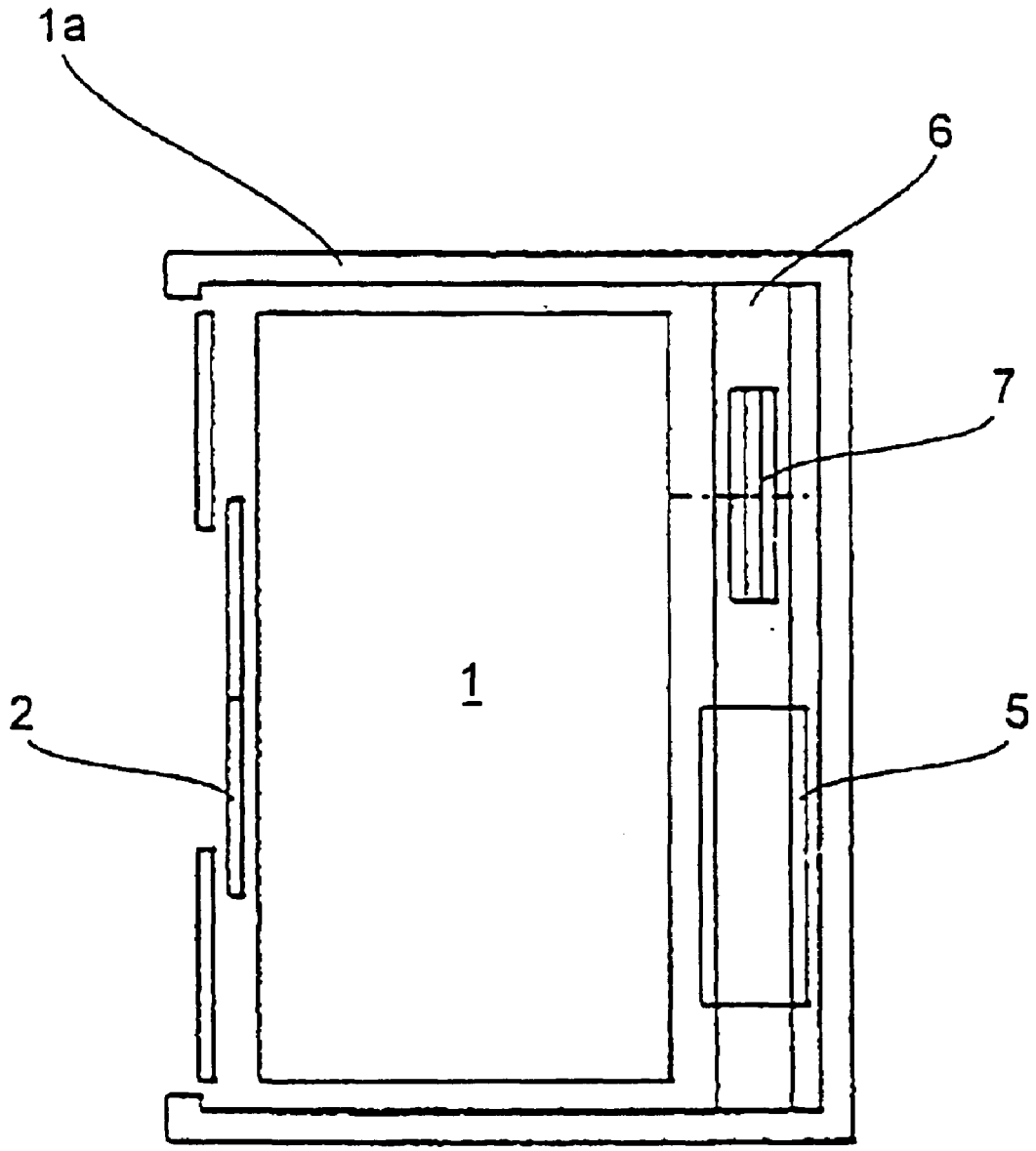
FIG. 5 is a top view onto another embodiment of the present invention.

FIG. 5 in schematic view shows an embodiment in accordance with the invention, in which said elevator cabin 1 is arranged in rucksack-like manner in front of the means of up- and downward movement of said elevator cabin 1. All means for moving said elevator cabin 1 as well as said counterweight 5 in upward and downward direction within said elevator shaft la therein are combined in a mounting unit 6 which can be flatly disposed in front of the rear wall of said elevator shaft, wherein in FIG. 5 only said driving disk 7 is shown schematically. Said driving disk 7 in the embodiment shown in FIG. 5 instead of a driving disk can also be a ring engine. However, a drive with gear also is conceivable, wherein drive and/or gear are located in the rear wall of said elevator shaft 1*a* and wherein the perforated plate principle is made use of.

Figure 6:
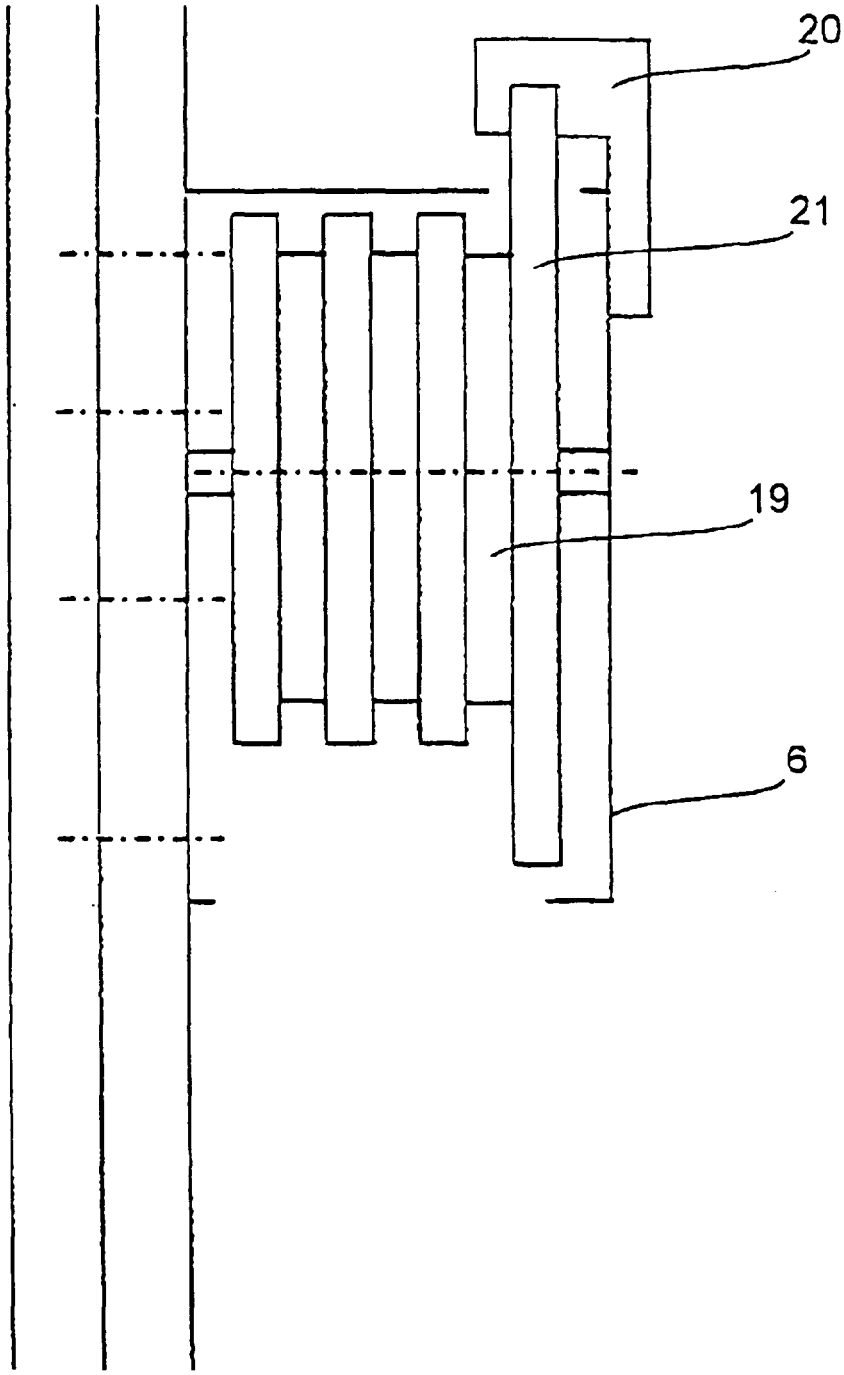
FIG. 6 is a detailed view of a cable sheave in accordance with one of the embodiments of FIGS. 1 to 5 with integrated disc brake.

FIG. 6 in schematic way shows a cable sheave 19 mounted in a mounting frame 6. On said mounting frame 6 in addition a preferably regulated cable brake 20 is arranged which runs in mesh with a brake disk 21 fixed to said cable sheave 19.

Figure 7:
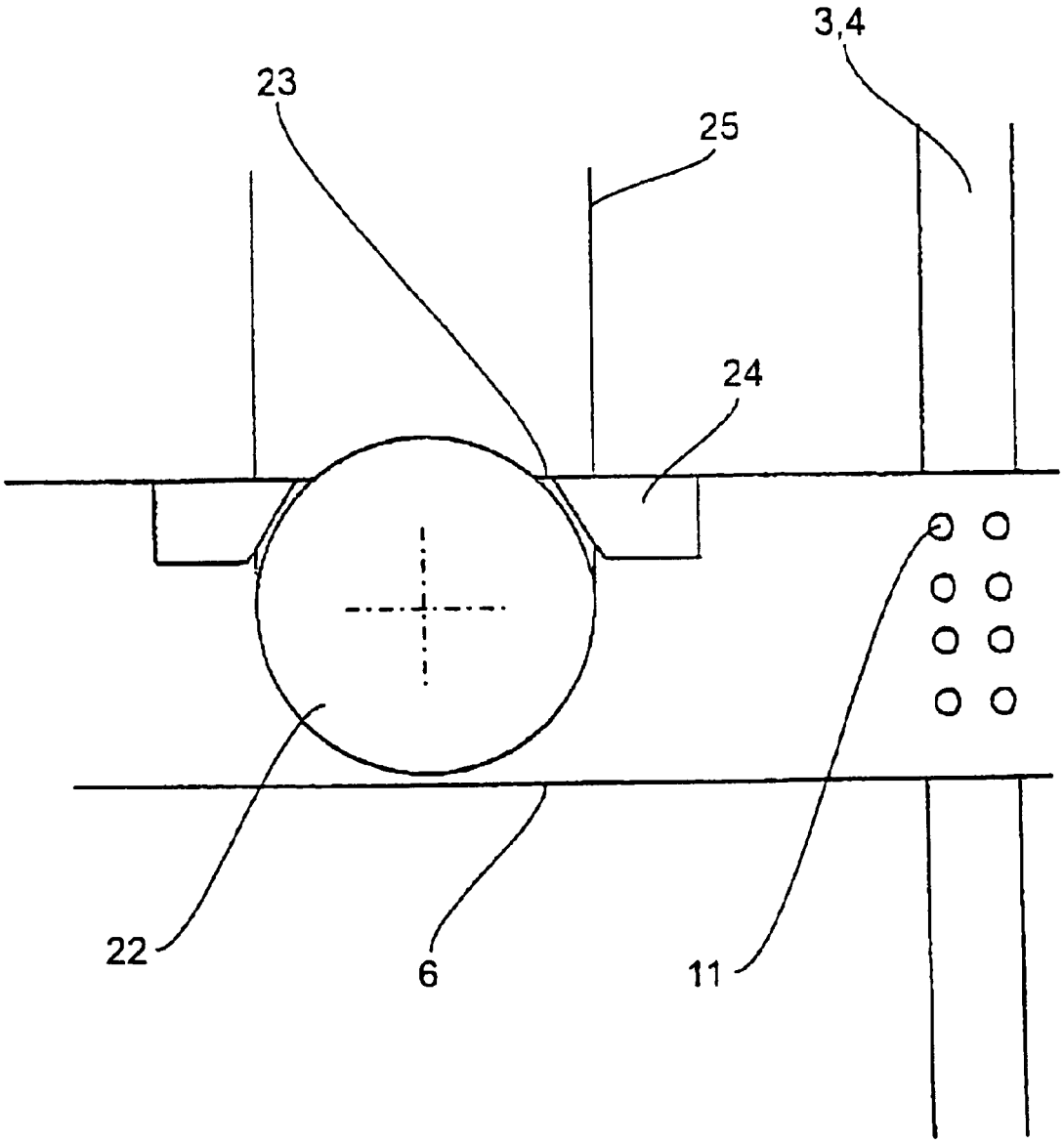
FIG. 7 is a detailed side view of a cable sheave in accordance with one of the embodiments of FIGS. 1 to 5 with integrated emergency brake.
Figure 8:
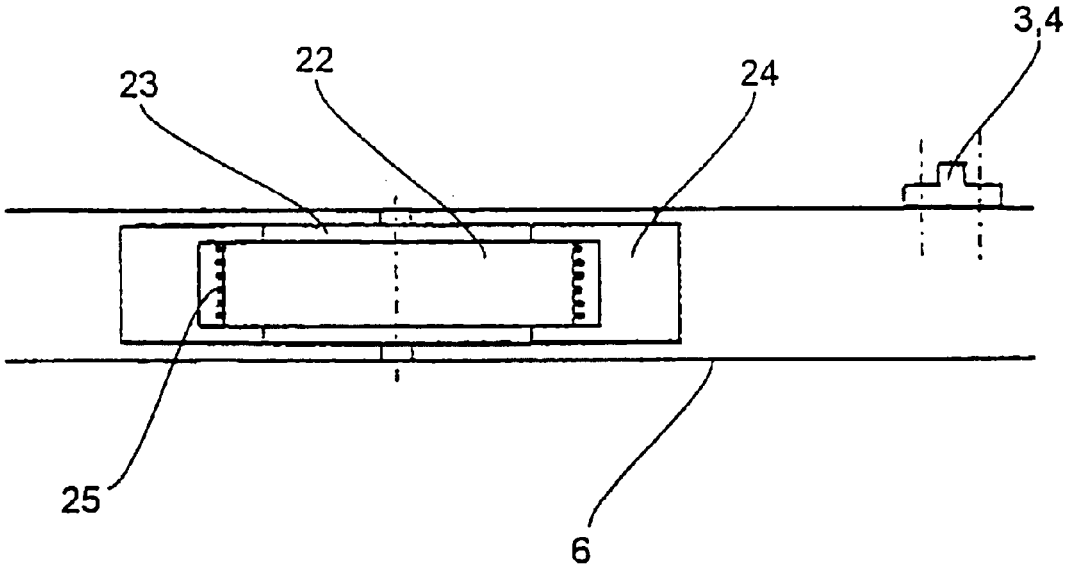
FIG. 8 is a top view onto the cable sheave of FIG. 7.

FIG. 7 in schematic way shows a cable sheave 22 rotatably arranged on a mounting frame 6 and preferably protruding upwardly through an opening 23 in the latter. Brake blocks 24 are disposed on both sides of said opening 23. In case of axial failure of said cable sheave 22 the latter is pulled in upward direction by the load of the elevator acting on said cables 25 into contact with said brake blocks 24 such that emergency braking of the elevator is effected. FIG. 8 shows a top view onto the arrangement under FIG. 7.

The further figures elucidate advantageous measurements for arranging the drive. Therein the drive can always be fixed outside of the "shaft cross-section" defined by said mounting frame, when the demand of optimum utilization of space requires fixation within the shaft cross-section defined by said mounting frame. Said mounting frames and said guide rails therefore will not be shown in the following, as the different manners of fixation are known to the expert.

Figure 9:
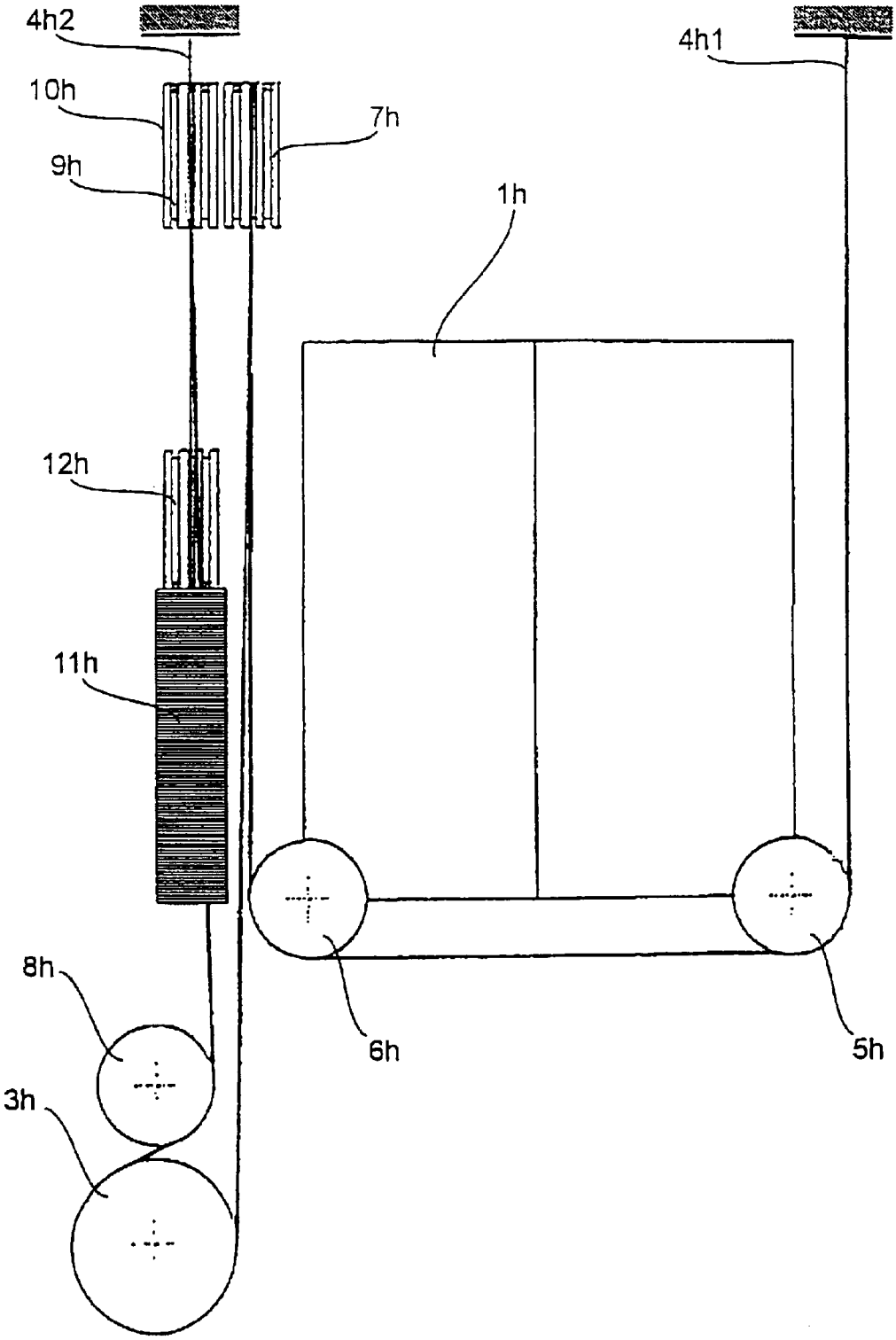
FIG. 9 is the schematic view of an embodiment of an elevator with a drive disposed in the elevator shaft.

FIG. 9 in a side view shows an elevator system with an elevator cabin 1*h* which is guided in lateral guides not shown, within said elevator shaft. Said elevator cabin 1*h* in accordance with the embodiment shown in FIG. 9 is lifted and lowered using a drive 3*h* which may be a so-called flat engine, a disk engine or a driving disk. The drive therein acts on a cable or flat belt 4*h* which, as shown, is anchored with both ends 4*h*1 and 4*h*2 at the ceiling of said elevator shaft (2:1 principle). Said cable or flat belt 4*h* therein runs from its first anchoring point 4*h*1 on the ceiling of said elevator shaft over a first sheave 5*h* located below said elevator cabin 1*h* to a second sheave 6*h* also located below said elevator cabin 1*h* and from there to a sheave 7*h* disposed below the ceiling of said elevator shaft. Said cable or flat belt 4*h* again is deflected by said sheave 7*h* and is guided within said elevator shaft in downward direction to said drive 3*h* and again is guided around the latter, wherein looping of said drive 3*h* of approximately three quarters of the circumference can be achieved by a correspondingly arranged further deflection sheave 8*h*. From said sheave 8*h* said cable or flat belt 4*h* again leads in upward direction to a deflection sheave 9*h* also disposed below the ceiling of said elevator shaft and from there horizontally to a further deflection sheave 10*h*. From said deflection sheave 10*h* said cable or flat belt 4*h* is guided in downward direction to a deflection sheave 12*h* located at a counterweight 11*h*, wherefrom said cable or flat belt 4*h* again leads in upward direction to said second fixation point 4*h*2 on the ceiling of said elevator shaft.

Figure 10:
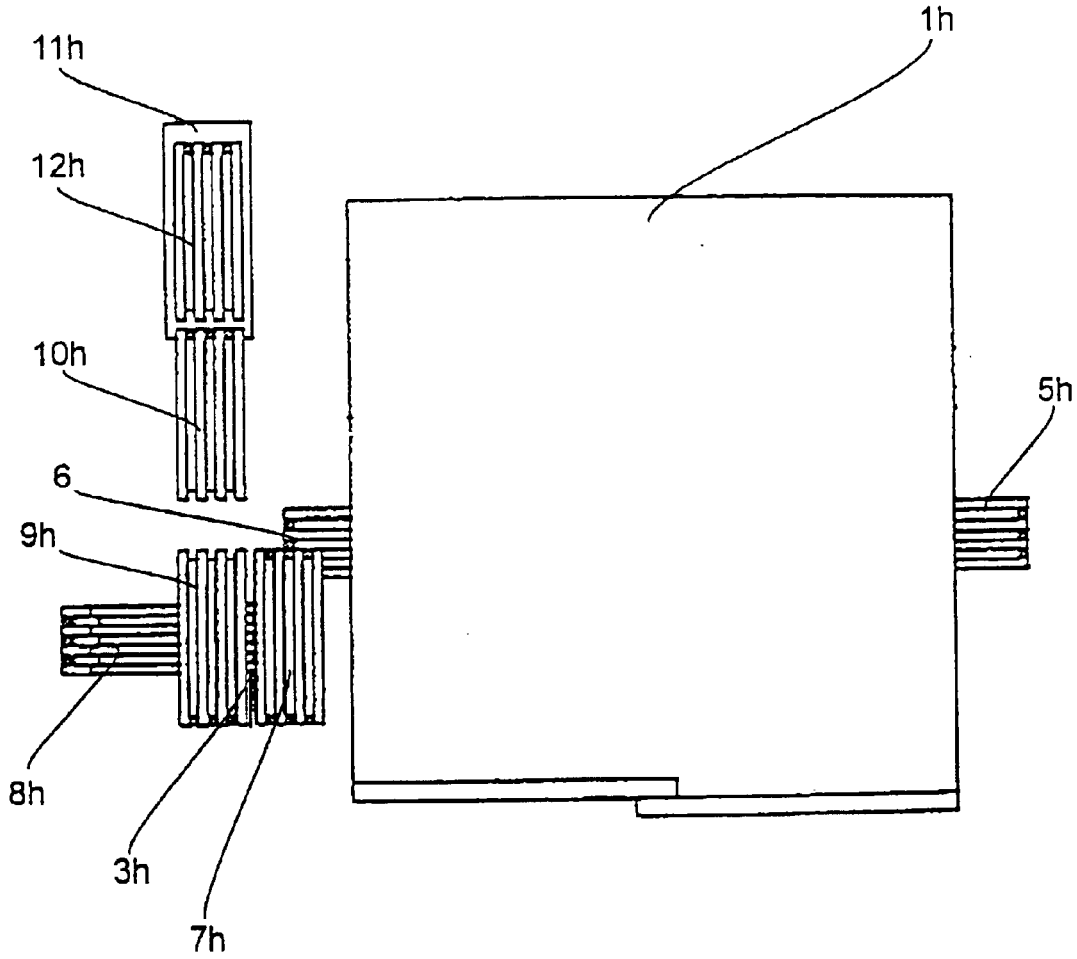
FIG. 10 is a top view onto the embodiment of FIG. 9.

FIG. 10 shows the same elements as FIG. 1, but in top view onto the arrangement.

Figure 11:
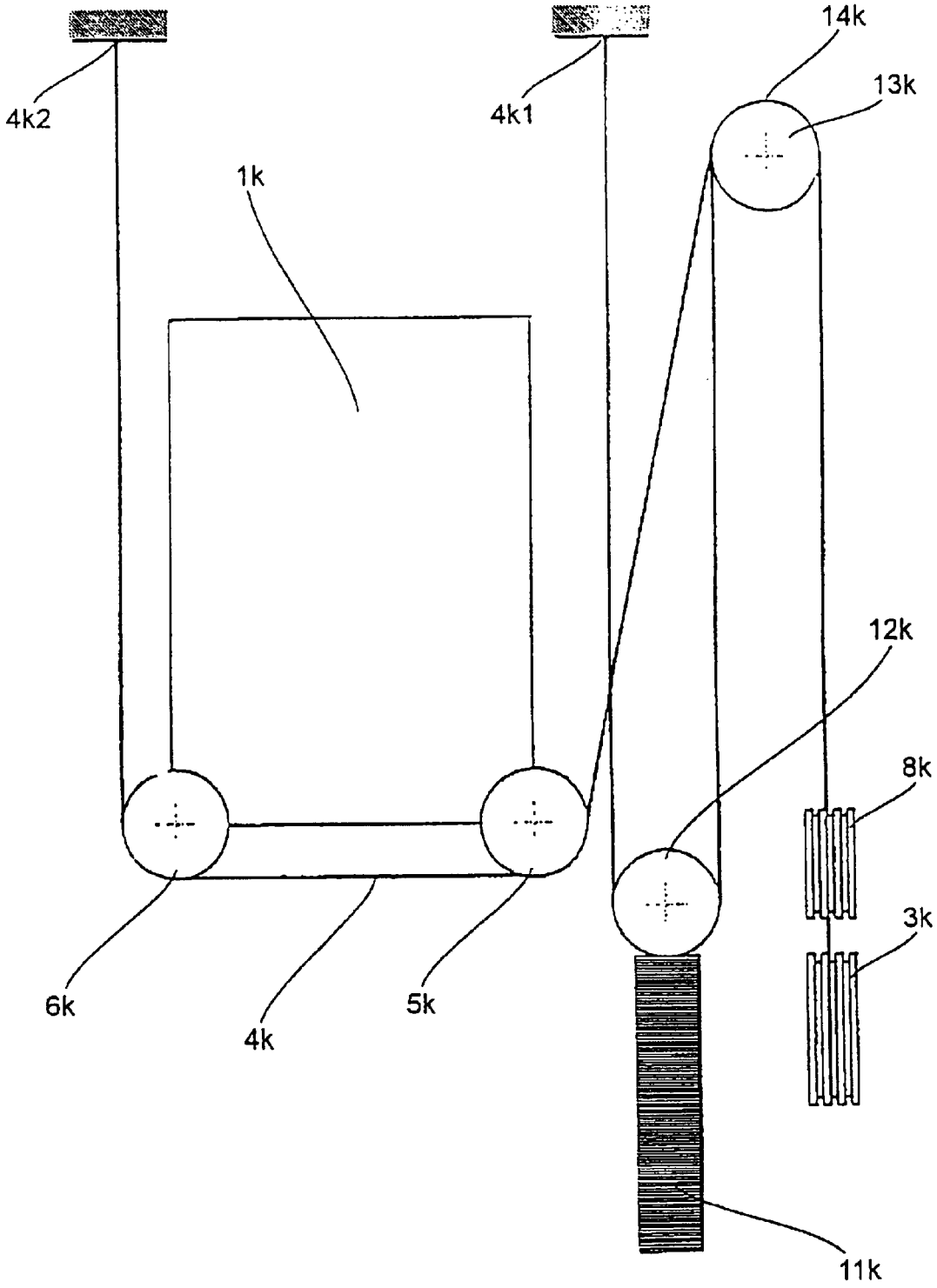
FIGS. 11 and 12 are schematic side views of further embodiments.

In FIG. 11 an alternative embodiment of the course of said cables or flat belts for upward and downward movement of said elevator cabin 1*k* is shown (also 2:1 principle). Herein, the axes of rotation of said flat engine 3*k* as well as of said deflection sheave 8*k* being in direct efficiency contact with said flat engine 3*k* are arranged at right angle to the axis of rotation of the deflections sheaves 5*k* and 6*k* disposed on the bottom side of said elevator cabin as well as to the axis of rotation of said deflection sheave 12*k* on said counterweight 11*k* as well as to the axis of rotation of said deflection sheaves 13*k* and 14*k* in operation rotating in opposite directions. In the modification shown in FIG. 11 of the course of said cable or flat belt 4*k* for lifting and lowering said elevator cabin 1*k* one deflection sheave has been saved as compared to the embodiment under FIG. 9 as said deflection sheaves 7*k*, 9*k* and 10*k* of FIGS. 9 and 10 are substituted for by deflection sheaves 13*k* and 14*k* under FIG. 11.

Figure 12:
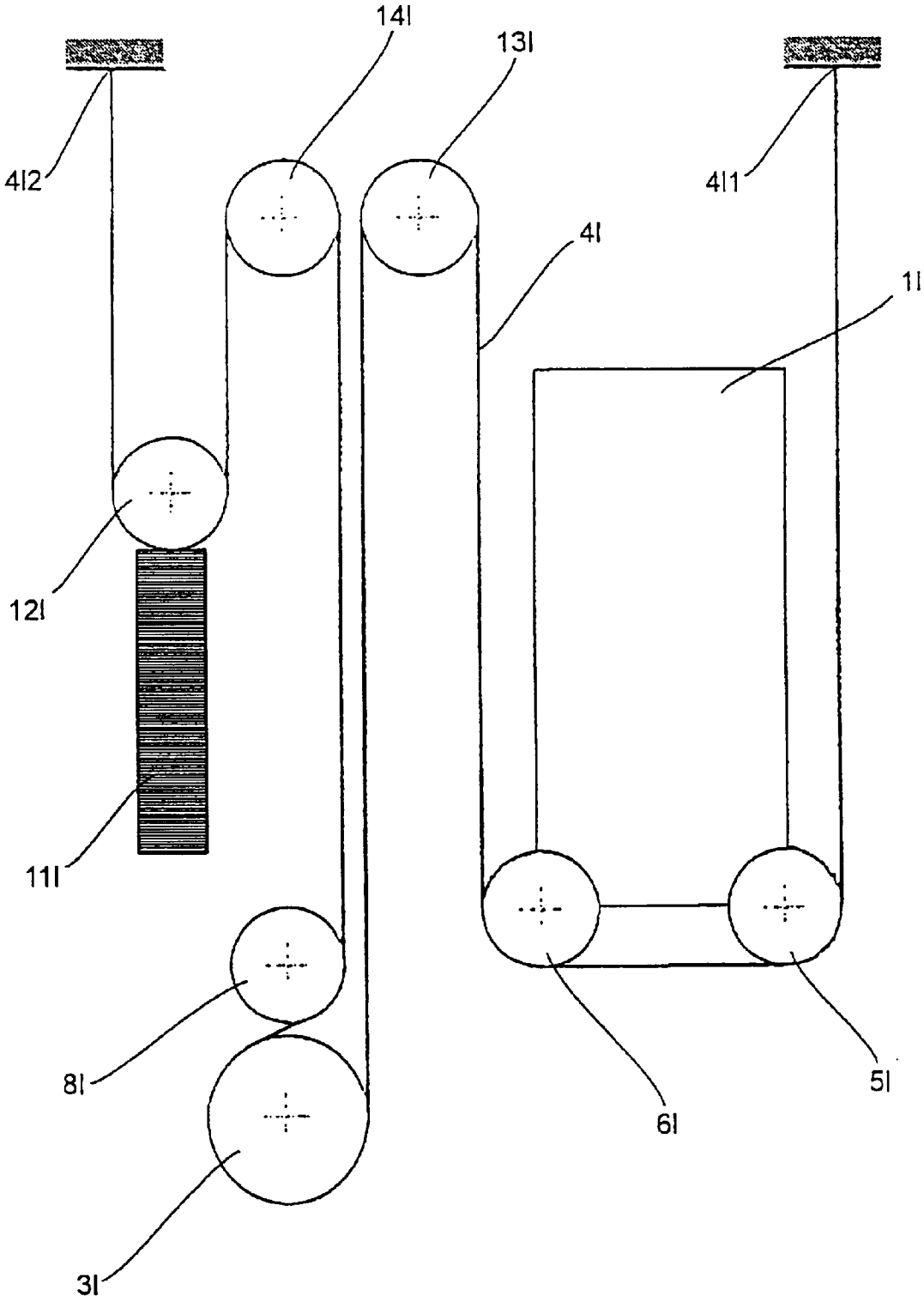

FIG. 12 shows a further modification of the course of said cable or flat belt 41 for lifting and lowering said elevator cabin 1*l* (also 2:1 principle). Herein, the orientation of the axes of rotation of said flat engine 3*l* as well as of said deflection sheaves 5*l*, 6*l*, 8*l*, 12*l*, 13*l* and 14*l* is in the same direction. Said deflections sheaves as well as said flat engine therein preferably are located in the same plane, this permitting a flat and room-saving arrangement out of flat engine and counterweight outside of the area of said elevator cabin itself.

Figure 13:
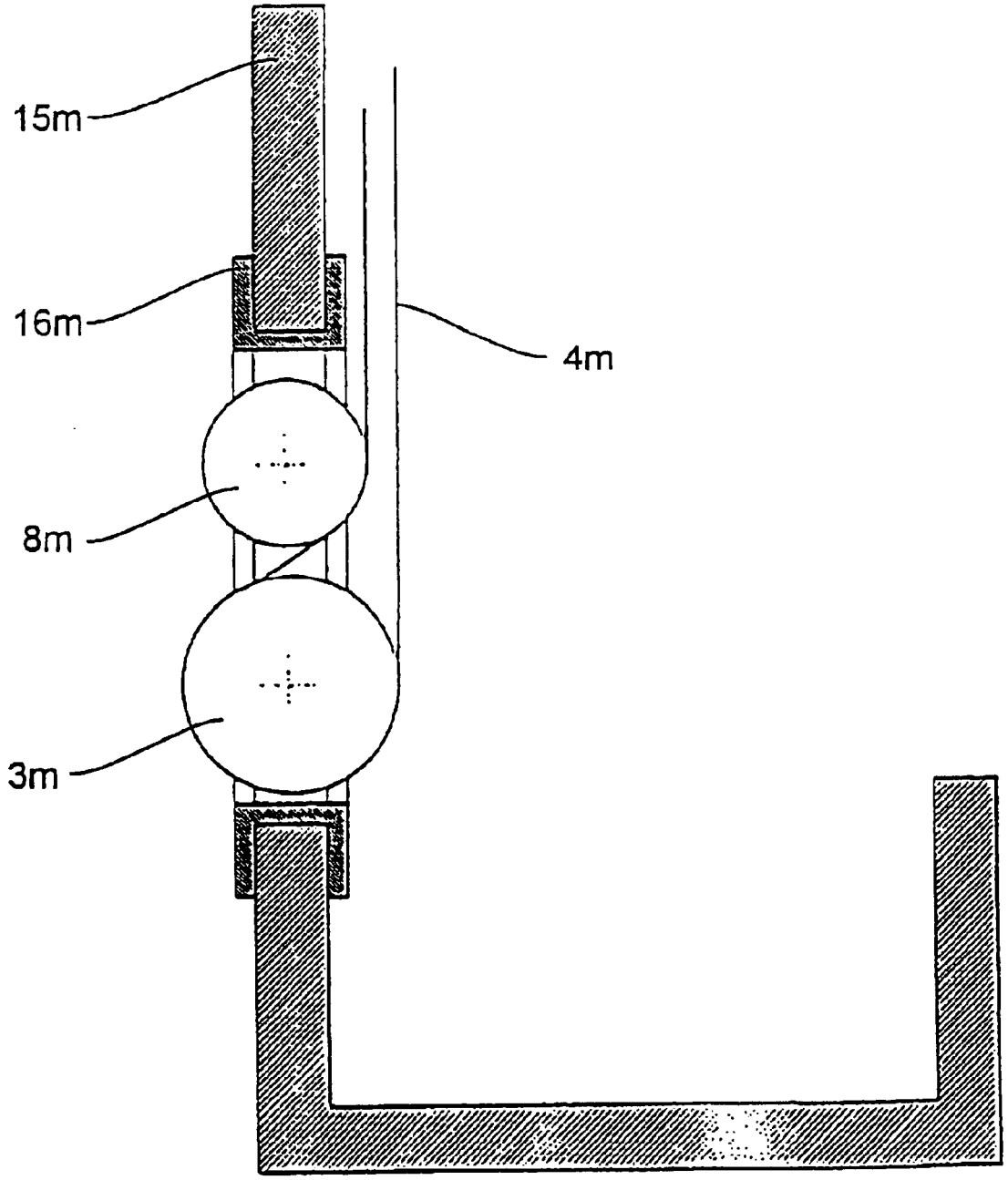
FIG. 13 is a detailed view of a drive unit as used in the embodiments under

FIG. 13 in schematic view shows the possible arrangement of said flat engine 3*m* as well as the relating deflection sheave 8*m*, as shown in the embodiments in accordance with FIGS. 9 to 12, in a possible positioning within a breakingthrough of an elevator shaft wall 15*m*, wherein said breakingthrough in the shown embodiment is provided with a bordering profiled frame 16*m*. The arrangement of flat engine 3*m* and deflection sheave 8*m* in said elevator shaft wall 15*m* can therein be provided for on the level of the underground floor or any other floor. Alternatively thereto, however, a positioning in the lateral door area on each floor or, however, in a shaft pit in front of said elevator shaft is conceivable. Said flat engine 3*m* therein simultaneously also serves as brake.

The embodiment of the preceding FIGS. 9 to 13 having a cable or flat belt 4*h–m* for lifting and lowering said elevator cabin 1*h–m*, which is fixed on the ceiling of said elevator shaft with both ends permits an essentially arbitrary arrangement of the individual elements of said elevator with respect to one another, whereby good accessibility of the drive units and thus simple assembly as well as maintenance can be guaranteed.

Figure 14:
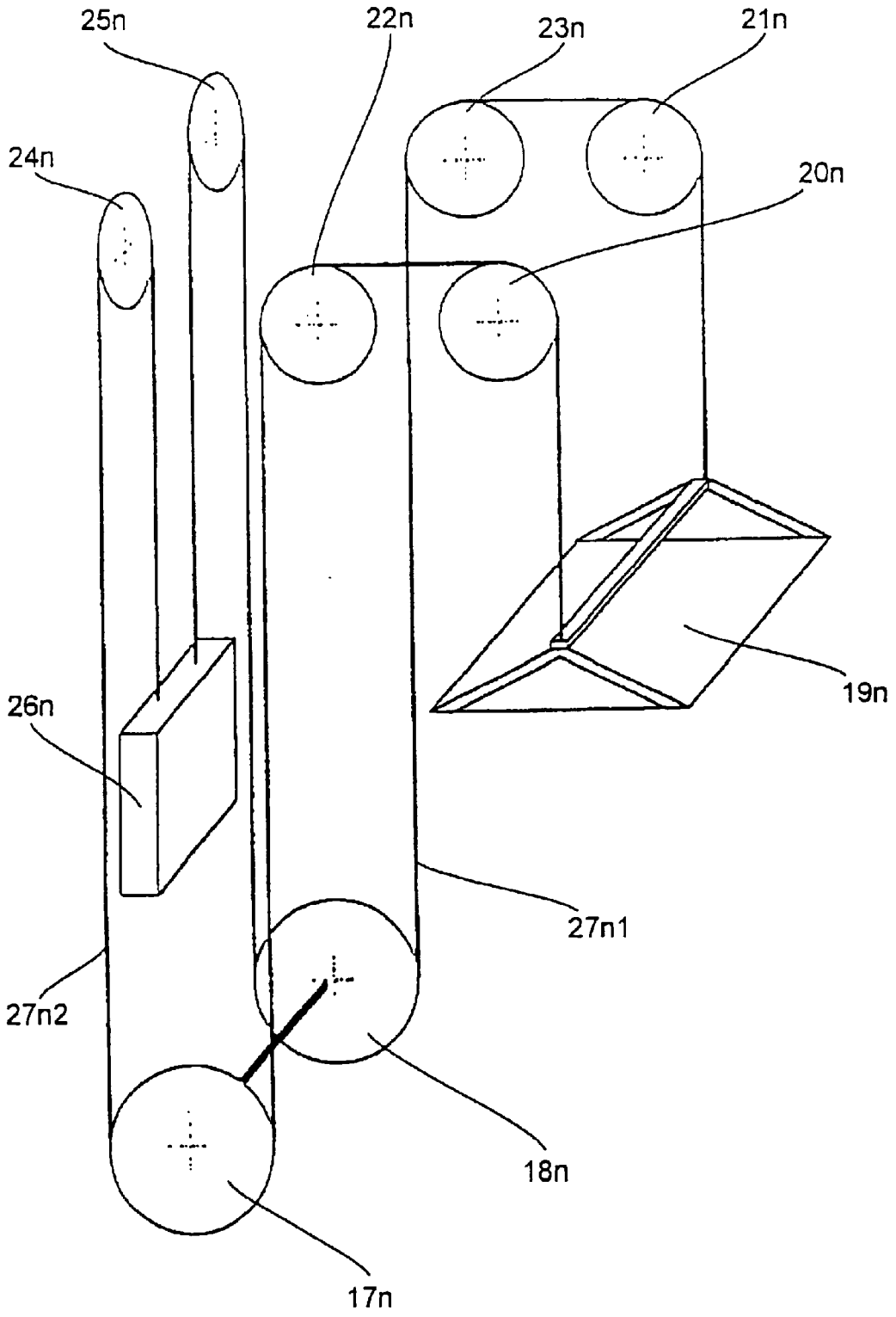

FIG. 14 shows a further embodiment of the invention, in which a drive with two driving disks 17*n* and 18*n* separately or commonly driven by a connecting shaft is provided for. In contrast to the embodiment shown in FIGS. 9 to 13, under the modifications under FIGS. 14 to 16 of a further embodiment an elevator cabin is not lifted and lowered by a cable or flat belt fixed with both ends to the ceiling of said elevator shaft and which runs over deflection sheaves and a flat drive, but by two cables or flat belts 27*n*1 and 27*n*2 arranged in mirror-inverted manner with respect to one another. Therein, the ends respectively are fixed to a frame 19*n* on which an elevator cabin is to be suspended as well as to a counterweight 26*n* (thus the so-called 1:1 principle is realized). Between these two ends said cables or flat belts, respectively, 27*n*1 and 27*n*2 run over said deflection sheaves 21*n* and 23*n* or 20*n* and 22*n*, respectively to a driving disk 18*n* or 19*n* and from there over a deflection sheave 25*n* or 24*n* to said counterweight 26*n*. Said deflection sheaves 21*n* to 25*n* therein are fixed under the ceiling of an elevator shaft not shown, directly or via one or several frames, wherein the axes of rotation of said deflection sheaves 24*n* and 25*n* over which said cables or flat belts 27*n*1 and 27*n*2 run to said counterweight 26*n* are arranged at right angle to the course of the axis of rotation of the remaining deflection sheaves 20*n* to 23*n*.

Figure 15:
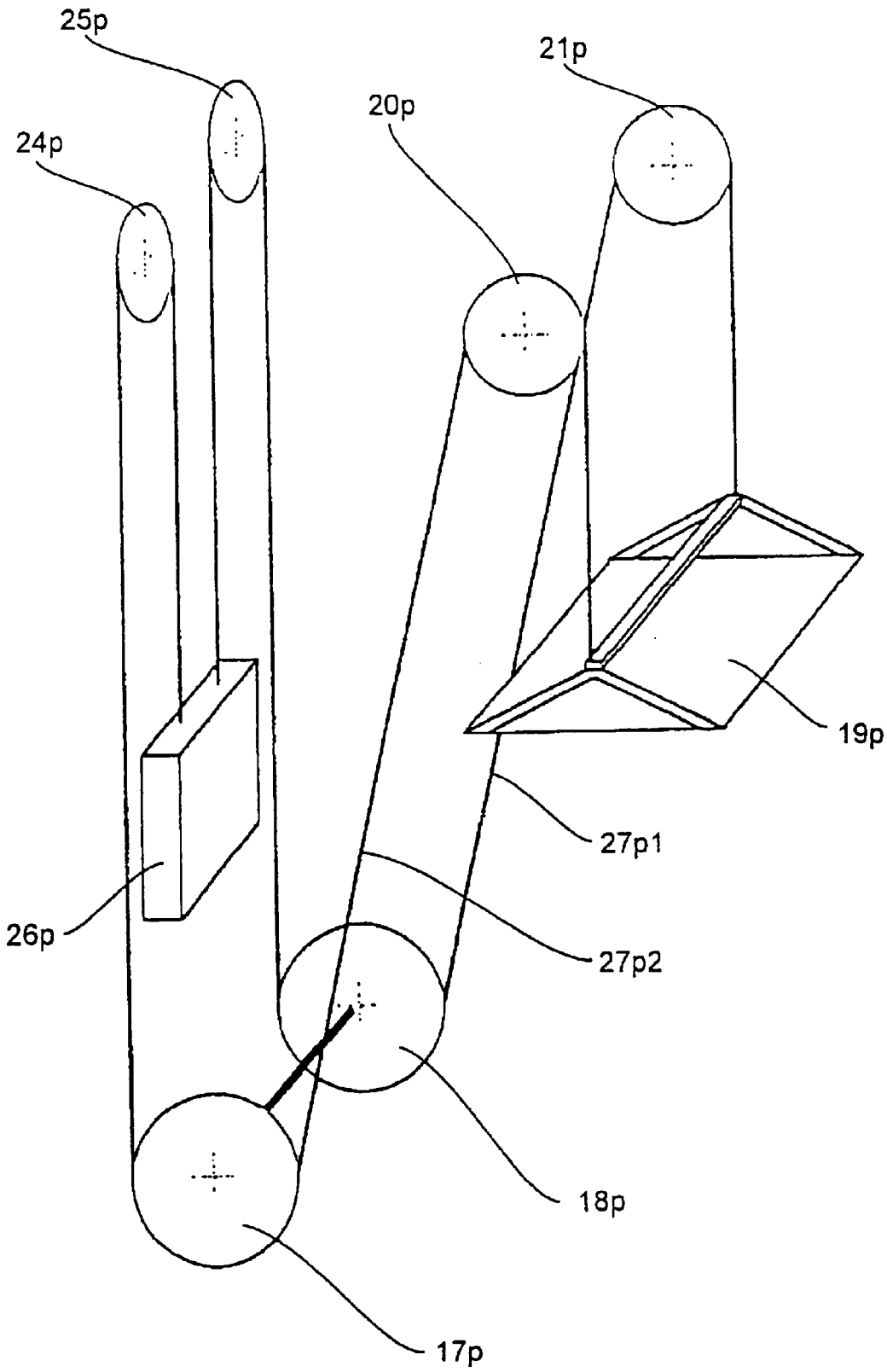

FIG. 15 essentially shows the same arrangement as can be seen from FIG. 14, however, said cables or flat belts 27*p*1 and 27*p*2 leading from said deflection sheaves 20*p* and 21*p* directly to said driving disks 17*p* and 18*p*, wherein said deflection sheaves 22*n* and 23*n* can be saved as can be seen from FIG. 14.

Figure 16:
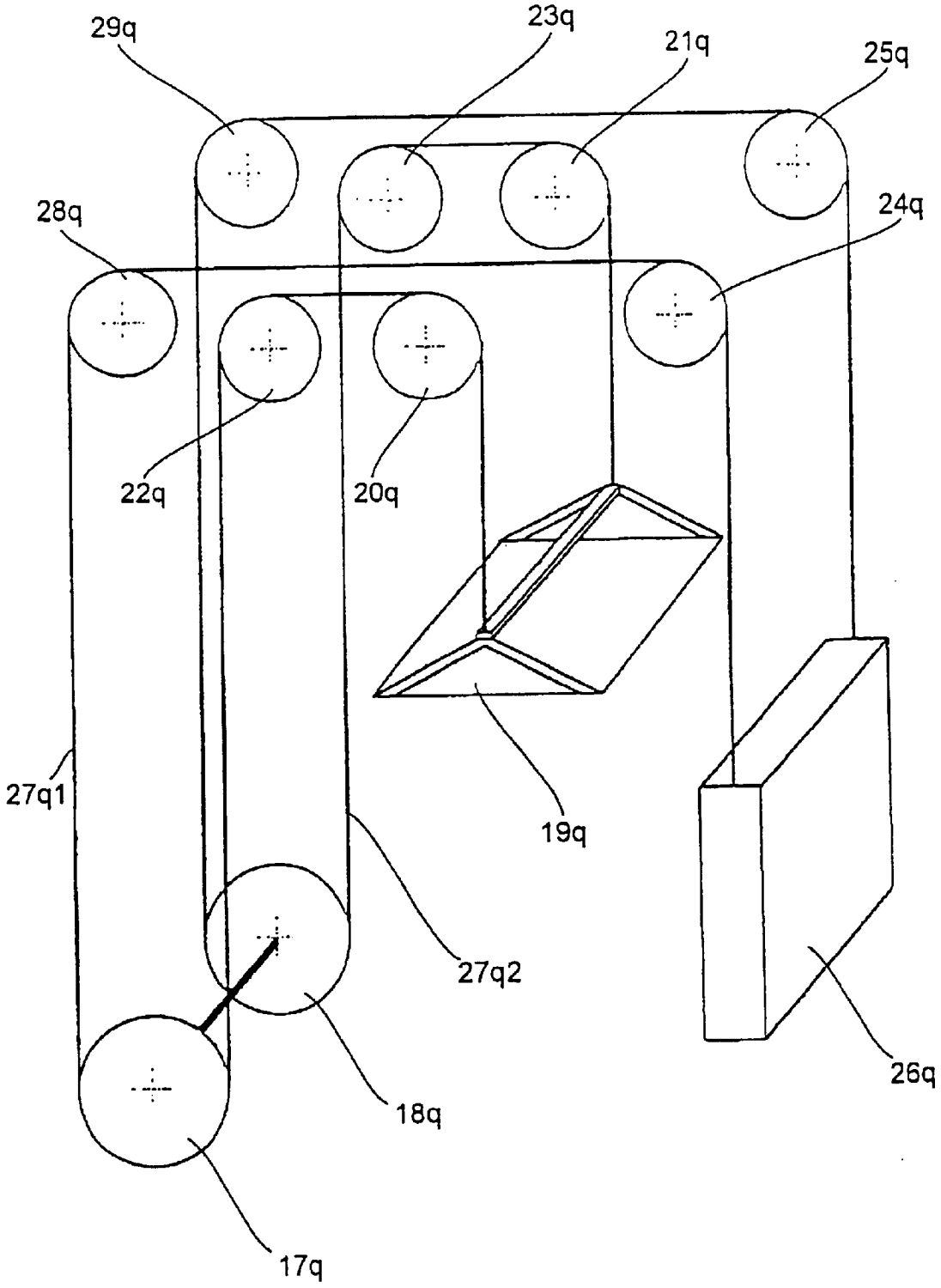

FIG. 16 finally shows a further modification of the embodiments under FIGS. 14 and 15, wherein in addition to said deflection sheaves 20*n* to 25*n* to be seen from FIG. 14 (here 20*q* to 25*q*) further deflection sheaves 28*q* and 29*q* are provided for and said deflection sheaves 24*q* and 25*q* are disposed on the opposite side of said driving disks 17*q* and 18*q* seen with respect to the frame 19*q*, the axis of rotation of said deflection sheaves 24*q* and 25*q* corresponding to the orientation of the axes of rotation of said deflection sheaves 20*q* to 23*q* as well as 28*q* and 29*q*. Thus, the drive and/or said driving disks, respectively, 17*q* and 18*q* as well as said counterweight 26*q* can be arranged on the opposite sides of said frame 19*q* and/or said elevator cabin, respectively, suspended thereon.

Figure 17:
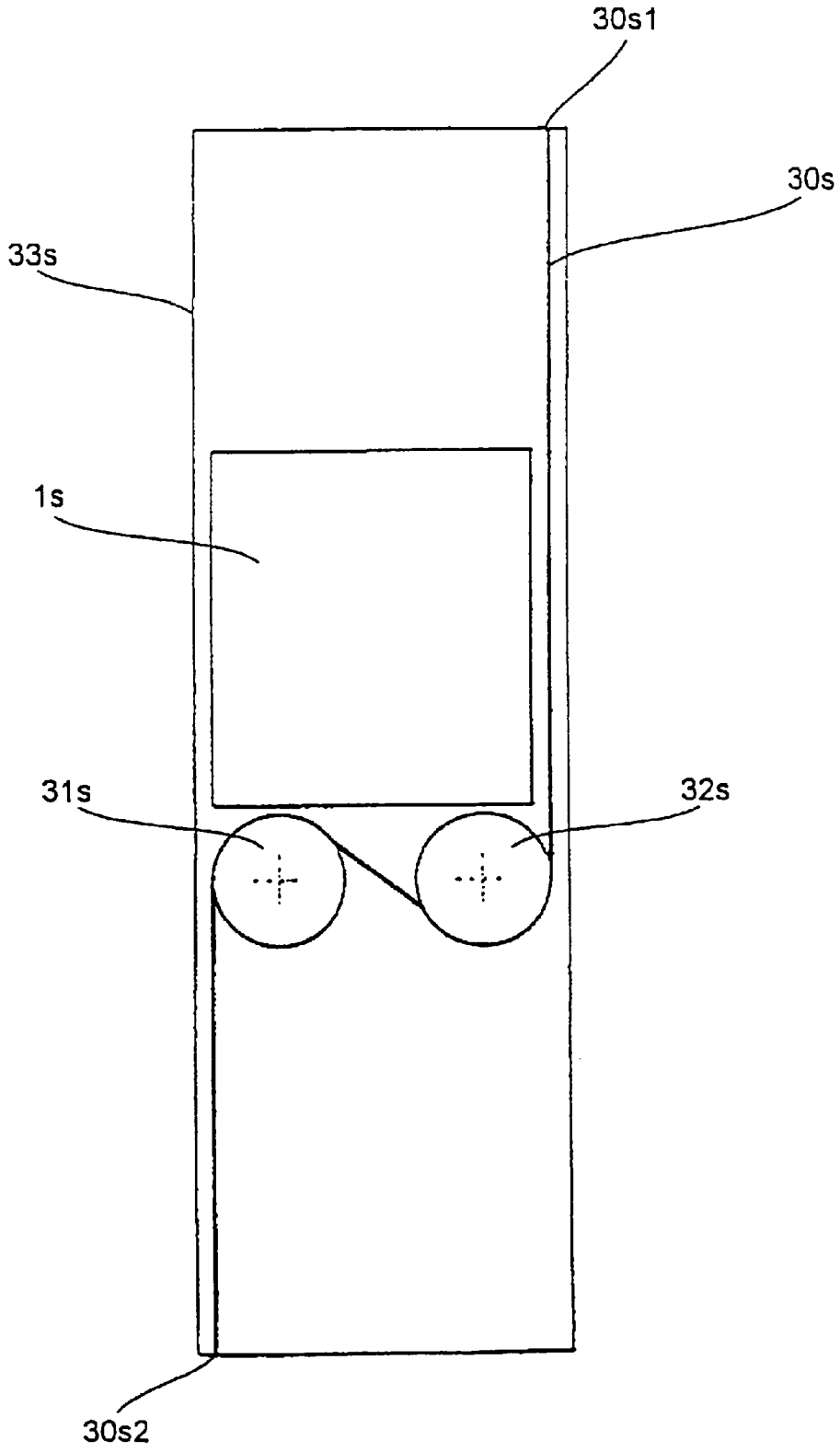

FIG. 17 shows a further embodiment of the invention, a drive 31*s* being arranged on the bottom side of an elevator cabin 1 (guide not shown) guided in an elevator shaft 33*s*, said drive acting on a cable or a flat belt 30*s* which is fixed on point 30*s*1 on the ceiling of said elevator shaft 33*s* as well as on point 30*s*2 on the bottom of said elevator shaft 33*s*. For achieving sufficient looping of said drive 31*s* preferably embodied as flat engine, an additional deflection sheave 32*s* is therein arranged below said elevator cabin 1.

Of course, also a combination of the individual features of the shown embodiments is possible.

What is claimed is:

1. An elevator comprising:

a drive moving an elevator cabin running in a self-supporting shaft scaffold and a counterweight in upward and downward directions in effective connection with one or more bending-flabby means guided over deflection sheaves, wherein said shaft scaffold is composed of:

vertical segmental guide elements for said elevator cabin and said counterweight; and horizontal module-shaped mounting frames connected to said segmental guide elements, said segmental guide elements serving both as vertical guideways for said elevator cabin and said counterweight and as the sole vertical support to said shaft scaffold.

2. The elevator as defined in claim 1, wherein said drive is arranged within said self-supporting shaft scaffold and lifts and/or lowers the elevator cabin and said counterweight in said self-supporting shaft scaffold by said bending-flabby means guided over an arrangement of deflection sheaves and said drive is integrated into the arrangement of deflection sheaves as an element deflecting said bending-flabby means.

3. The elevator as defined in claim 1, wherein said deflection sheaves are mounted in said mounting frames for lifting and lowering said elevator cabin and said counterweight.

4. The elevator as defined in claim 1, wherein said mounting frames are made of squared sheets.

5. The elevator as defined in claim 1, wherein said segmental guide elements are segmented into a plurality of segments, and said segments are engaged at a working face formed by a mechanism comprising a female member and a male member with a snug fit there between.

6. The elevator as defined in claim 5, wherein said working face is disposed in the area of said mounting frames, each respective mounting frame serving as a connecting element for the respective segments of said guide elements.

7. The elevator as defined in claim 1, wherein said drive consists of separately driven driving disks.

8. The elevator as defined in claim 1, wherein at least two of said deflection sheaves are made rotate by a drive by a full floating axle or hollow shaft.

9. The elevator as defined in claim 1, wherein said drive is formed with gear.

10. The elevator as defined in claim 1, wherein said drive is arranged outside of said self-supporting shaft scaffold formed by said mounting frames and said segmental guide elements.

11. The elevator as defined in claim 1, wherein said drive is arranged within said self-supporting shaft scaffold formed by said mounting frames and said segmental guide elements.

12. The elevator as defined in claim 1, further comprising a regulated cable brake on at least one of said mounting frames, the regulated cable brake running in mesh with a brake disk fixed to said deflection sheaves arranged in said mounting frame.

13. The elevator as defined in claim 1, further comprising an emergency brake coming into engagement with the cable sheave in case of failure of the axis of said deflection sheave arranged in said mounting frame, on at least one of said mounting frames.

14. The elevator as defined in claim 1, wherein said drive is arranged on the level of a floor or underground floor exit of said self-supporting shaft scaffold.

15. The elevator as defined in claim 1, wherein said drive is arranged in a shaft pit in front of said self-supporting shaft scaffold.

16. The elevator as defined in claim 1, wherein said drive is arranged on said elevator cabin.

17. The elevator as defined in claim 1, wherein said drive is arranged on said counterweight.

18. The elevator as defined in claim 1, wherein said bending-flabby means is a flat belt or a cable.

19. The elevator as defined in claim 1, wherein said drive is formed without gear.

20. The elevator as defined in claim 1, wherein said drive is formed as a ring engine.

21. The elevator as defined in claim 1, wherein said drive is formed as a disk engine.

22. The elevator as defined in claim 1, wherein said drive is formed as a flat engine.

23. An elevator comprising:

a drive moving an elevator cabin running in a self-supporting shaft scaffold and a counterweight in upward and downward directions in effective connection with one or more bending-flabby means guided over deflection sheaves, wherein said shaft scaffold consists essentially of:

vertical segmental guide elements for said elevator cabin and said counterweight; and horizontal module-shaped mounting frames connected to said segmental guide elements, said segmental guide elements serving both as vertical guideways for said elevator cabin and said counterweight and as the sole vertical support to said shaft scaffold.

* * * * *